US009388362B2

(12) United States Patent
Suen

(10) Patent No.: US 9,388,362 B2
(45) Date of Patent: Jul. 12, 2016

(54) FRICTION MODIFIERS AND A METHOD OF MAKING THE SAME

(71) Applicant: Yat Fan Suen, Martinez, CA (US)

(72) Inventor: Yat Fan Suen, Martinez, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 152 days.

(21) Appl. No.: 13/663,744

(22) Filed: Oct. 30, 2012

(65) Prior Publication Data

US 2014/0121142 A1 May 1, 2014

(51) Int. Cl.

| | |
|---|---|
| ***C10M 141/02*** | (2006.01) |
| ***C10M 139/00*** | (2006.01) |
| ***C07F 5/04*** | (2006.01) |
| ***C10M 159/12*** | (2006.01) |

(52) U.S. Cl.

CPC ..... *C10M 159/12* (2013.01); *C10M 139/00* (2013.01); *C10M 2205/028* (2013.01); *C10M 2209/084* (2013.01); *C10M 2223/045* (2013.01); *C10M 2227/061* (2013.01); *C10N 2230/06* (2013.01); *C10N 2230/54* (2013.01); *C10N 2240/10* (2013.01); *C10N 2270/02* (2013.01)

(58) Field of Classification Search

CPC . C10M 129/78; C10M 129/16; C10M 129/74
USPC ..... 508/195, 160, 200
See application file for complete search history.

(56) References Cited

U.S. PATENT DOCUMENTS

| | | | | |
|---|---|---|---|---|
| 3,011,880 | A | 12/1961 | Chien-Wei et al. | |
| 4,046,802 | A | 9/1977 | Elliott et al. | |
| 4,085,126 | A | 4/1978 | McConnell et al. | |
| 4,116,986 | A | 9/1978 | Bistline, Jr. et al. | |
| 4,231,883 | A | 11/1980 | Malec | |
| 4,331,545 | A | 5/1982 | Papay et al. | |
| 4,382,006 | A | 5/1983 | Horodysky | |
| 4,389,322 | A | 6/1983 | Horodysky | |
| 4,406,802 | A | 9/1983 | Horodysky | |
| 4,478,732 | A | 10/1984 | Horodysky | |
| 4,507,216 | A * | 3/1985 | Braid et al. | 508/198 |
| 5,006,270 | A | 4/1991 | Farng et al. | |
| 5,034,447 | A | 7/1991 | Izumida et al. | |
| 6,245,725 | B1 | 6/2001 | Tanaka et al. | |
| 6,803,350 | B2 | 10/2004 | Lantuejoul et al. | |
| 7,691,794 | B2 | 4/2010 | Muir | |
| 2005/0107623 | A1 | 5/2005 | Fox et al. | |
| 2006/0019838 | A1 * | 1/2006 | Muir | 508/198 |
| 2007/0155631 | A1 | 7/2007 | Muir | |
| 2012/0129743 | A1 | 5/2012 | Suen | |

FOREIGN PATENT DOCUMENTS

| | | | |
|---|---|---|---|
| CN | 102702009 | A | 10/2012 |
| EP | 393748 | | 10/1990 |
| JP | 2005320441 | | 11/2005 |
| WO | 2012071185 | A2 | 5/2012 |

OTHER PUBLICATIONS

Khanmohammadi, M. et al. "Quantitative Monitoring of the Amidation Reaction Between Coconut Oil and Diethanolamine by Attenuated Total Reflectance Fourier Transform Infrared Spectrometry", Journal of Surfactants and Detergents, Dec. 28, 2008, vol. 12, Issue 1: p. 38, scheme 1, p. 37, paragraph 3.

http://www.pcimag.com/ext/resources/VirtualBrochure/Solvay.pdf (retrieved Aug. 6, 2015).

MSDS Product Sheet, IGEPAL CA-210. Jan. 2015.

Supplementary European Search Report, Application No. EP13850779, Oct. 5, 2015.

* cited by examiner

*Primary Examiner* — Prem C Singh
*Assistant Examiner* — Francis C Campanell
(74) *Attorney, Agent, or Firm* — Carlton Virassammy

(57) ABSTRACT

A lubricating oil additive composition comprising the reaction product of an (a) an alkylated aromatic ether alcohol, (b) a source of boron, and (c) a hydrocarbyl polyol, having at least two hydroxyl groups.

25 Claims, No Drawings

FRICTION MODIFIERS AND A METHOD OF MAKING THE SAME

FIELD OF THE INVENTION

This invention relates to new lubricating oil additives and lubricating oil compositions comprising the new lubricating oil additives. More specifically, it relates to passenger car engines and heavy duty diesel engines having lubricating oil compositions containing a friction reducing component comprising an alkylated aromatic ether alcohol that is co-borated with a hydrocarbyl polyol having at least two hydroxyl groups.

BACKGROUND OF THE INVENTION

In the realm of friction modifiers used in passenger car motor oils, there are many options. One of the many options available as an engine oil friction modifier is bis-ethoxy oleylamine which has been used for a number of years as a friction modifier.

Until recently, diesel engine oil formulators focused on the problem of maximizing the useful life of a lubricant and the engine it is used in. This has been done with the aid of wear inhibitors and antioxidants. Formulators had not spent too much time on tuning an engine oil's characteristics in order to maximize fuel economy.

A number of factors have contributed to the recent interest in improving diesel engine fuel economy. Global climate change legislation has slowly but steadily been limiting emissions from diesel engines. In addition, the price of crude oil skyrocketed in 2008. Suddenly fuel costs had superseded labor costs as the single largest expense of many truck fleets. Although the price of crude has dropped off significantly from where it peaked at $145/barrel in 2008, fuel economy is firmly established as an important issue for OEMs, diesel engine owners and diesel engine oil producers.

Addressing fuel economy in heavy duty diesel engines in a manner parallel to that used in passenger car engines has proven to not be the best strategy. Friction modifiers that have been used with success in passenger car engine oils show disappointing results in diesel engines. Reducing friction by reducing the viscosity of the oil has lead to wear issues. Obviously, a new approach is needed to tackle the problem of fuel economy in diesel engines.

New organic friction modifiers (OFMs) designed to function in both passenger car and heavy duty diesel engine oils have begun to emerge. Surprising benefits in friction reduction have been seen with a new class of mixed borate esters of bis-ethoxy alkylamines/amides. These benefits have been demonstrated through both bench and engine testing.

Malec, U.S. Pat. No. 4,231,883 teaches the use of alkoxylated hydrocarbyl amines as friction modifiers.

Chien-Wei et al., U.S. Pat. No. 3,011,880 teaches the use of borate esters of bis alkoxylated hydrocarbyl amides as fuel additives to improve resistance to deposits and low temperature operation.

Colombo, EP393748 teaches the use of borate esters of mono and bis-ethoxylated alkyl amides as friction modifiers and anti corrosion agents in lubricants.

Papay et al., U.S. Pat. No. 4,331,545 teaches the use of borate esters of monoethoxylated hydrocarbyl amides as friction modifiers for both lubricants and fuels. Mixed borate esters with alkyl alcohols and polyhydric alcohols are described.

Horodysky, U.S. Pat. No. 4,382,006 teaches the use of borate esters of bis-ethoxylated alkyl amines as friction modifiers for lubricants. Example borate esters are mixed esters with butanol.

Horodysky, U.S. Pat. No. 4,389,322 teaches the use of borate esters of bis-ethoxylated alkyl amides as friction modifiers for lubricants. Example borate esters are mixed esters with butanol.

Horodysky et al., U.S. Pat. No. 4,406,802 teaches the use of mixed borate esters of compounds including bis-alkoxylated alkyl amines, bis-alkoxylated alkyl amides and alcohol hydroxyesters as friction modifiers in lubricants.

Horodysky et al., U.S. Pat. No. 4,478,732 teaches the use of mixed borate esters of compounds including bis-alkoxylated alkyl amines, bis-alkoxylated alkyl amides and alcohol hydroxyesters as friction modifiers in lubricants.

Yasushi, JP2005320441 teaches the use of a mixed borate ester of bis-ethoxylated alkyl amides and glycerol monoesters in low sulfur formulations as antiwear additives.

None of the lubricants previously described address the problem of friction modification in a diesel engine oil with an alkylated ether alcohol that is co-borated with hydrocarbyl polyol having at least two hydroxyl groups.

SUMMARY OF THE INVENTION

An embodiment of the present invention is directed to a lubricating oil additive composition comprising the reaction product of an (a) an alkylated aromatic ether alcohol, (b) a source of boron, and (c) a hydrocarbyl polyol, having at least two hydroxyl groups.

An embodiment of the present invention is directed to a lubricating oil composition comprising A. major amount of an oil of lubricating viscosity and B. a lubricating oil additive composition comprising the reaction product of (i) an alkylated aromatic ether alcohol, (ii) a source of boron, and (iii) a hydrocarbyl polyol, having at least three hydroxyl groups.

An embodiment of the present invention is directed to a method for reducing friction in an internal combustion engine comprising lubricating said engine with a lubricating oil composition comprising the lubricating oil composition comprising (A) major amount of an oil of lubricating viscosity and (B) a lubricating oil additive composition comprising the reaction product of (i) an alkylated aromatic ether alcohol, (ii) a source of boron, and (iii) a hydrocarbyl polyol, having at least three hydroxyl groups.

An embodiment of the present invention is directed to a lubricating oil additive concentrate comprising from about 90 wt. % to about 10 wt. % of an organic liquid diluent and from about 10 wt. % to about 90 wt. % of the lubricating oil additive composition comprising the reaction product of an (a) an alkylated aromatic ether alcohol, (b) a source of boron, and (c) a hydrocarbyl polyol, having at least two hydroxyl groups.

An embodiment of the present invention is directed to a method of preparing a lubricating oil additive composition comprising reacting (a) an alkylated aromatic ether alcohol, (b) a source of boron, and (c) a hydrocarbyl polyol, having at least three hydroxyl groups.

DETAILED DESCRIPTION OF THE INVENTION

While the invention is susceptible to various modifications and alternative forms, specific embodiments thereof and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

Lubricating Oil Additive

In one embodiment, the lubricating oil additive is the reaction product of an alkylated aromatic ether alcohol; a source of boron, such as boric acid; and a hydrocarbyl polyol having at least two hydrocarbyl groups.

Alkylated Aromatic Ether Alcohol

In one embodiment the alkylated aromatic ether alcohol has the following structure:

(I)

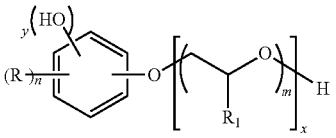

wherein R is an alkyl group having from 2 to 40 carbon atoms;

wherein m is an integer from 1 to 60 wherein n is an integer from 1 to 5;

wherein x is an integer from 1 to 5;

wherein y is 0 or an integer from 1 to 4;

wherein the sum of n+y+x is equal to an integer from 2 to 6; and wherein $R_1$ is hydrogen or is an alkyl group having from 1 to 10 carbon atoms.

In one embodiment, the alkylated aromatic ether alcohol is an alkylated aromatic polyether alcohol which may be prepared by methods that are well known in the art or may be purchased from Sigma-Aldrich St. Louis, Mo. In particular, Igepal® CA-210 may be purchased from Sigma-Aldrich.

Source of Boron Reactant

In one embodiment a source of boron such as boron trioxide or any of the various forms of boric acid—including meta-boric acid, ortho-boric acid, tetra-boric acid; or, alkyl borate—including mono-, di-, or tri-$C_1$-$C_6$ alkyl borate are used in the reaction. Preferably, boric acid is employed as the source of boron. Boric acid may be prepared by methods that are well known in the art. It may also be purchased from suppliers such as Sigma-Aldrich or Fischer.

Hydrocarbyl Polyol Reactant

In one embodiment, the hydrocarbyl polyol reactant includes hydrocarbyl polyol components and their derivatives, excluding esters, and has at least two hydroxyl groups. The hydrocarbyl polyol may be an aromatic polyol (e.g., resorcinol or catechol)

(II)

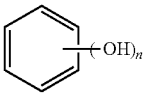

wherein n is an integer from 2 to 6.

Or, the hydrocarbyl polyol is an alkyl polyol (e.g., glycerol, diglycerol or pentaerythritol).

(III)

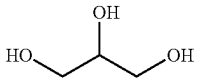

Glycerol (IV)

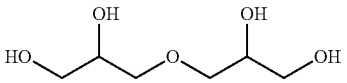

diglycerol (V)

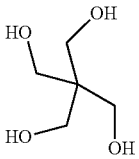

pentaerythritol

Preferably, the hydrocarbyl polyol component is an alkyl polyol having the following structure:

(VI)

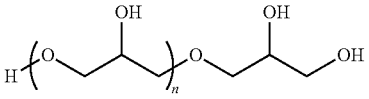

Wherein n is 0 or an integer from 1 to 5.

Preferably, n is 0. More preferred, the hydrocarbyl polyol component is glycerol.

Method of Making the Lubricating Oil Additive Composition

The lubricating oil additive composition is prepared by charging a vessel with an alkylated aromatic ether alcohol and an aromatic solvent. Preferably, the alkylated aromatic ether alcohol is alkylated ethoxylated phenol or resorcinol. A source of boron, such as boric acid, is then added to the vessel. The mixture is refluxed until the water has been substantially removed to drive the reaction to completion and then an hydrocarbyl polyol having at least two hydroxyl groups, such as glycerol, is added to the mixture.

In one embodiment, the hydrocarbyl polyol is added to the vessel at the same time as the source of boron. The mixture is then refluxed for two hours.

In one embodiment the ratio of the alkylated aromatic ether alcohol reactant, the source of boron and the hydrocarbyl polyol having at least three hydroxyl groups is from about 1:0.2:0.2 to 1:3:3, respectively.

Additive Concentrates

In many instances, it may be advantageous to form concentrates of the oil soluble additive composition of the present invention within a carrier liquid. These additive concentrates provide a convenient method of handling, transporting, and ultimately blending into lubricant base oils to provide a finished lubricant. Generally, the oil soluble additive concentrates of the invention are not useable or suitable as finished lubricants on their own. Rather, the oil soluble additive concentrates are blended with lubricant base oil stocks to provide a finished lubricant. It is desired that the carrier liquid readily solubilizes the oil soluble additive of the invention and provides an oil additive concentrate that is readily soluble in the lubricant base oil stocks. In addition, it is desired that the carrier liquid not introduce any undesirable characteristics, including, for example, high volatility, high viscosity, and impurities such as heteroatoms, to the lubricant base oil stocks and thus, ultimately to the finished lubricant. The present invention therefore further provides an oil soluble additive concentrate composition comprising an inert carrier fluid and from 2.0% to 90% by weight, based on the total concentrate, of an oil soluble additive composition according to the invention. The inert carrier fluid may be a lubricating oil.

These concentrates usually contain from about 2.0% to about 90% by weight, preferably 10% to 50% by weight of the oil soluble additive composition of this invention and may contain, in addition, one or more other additives known in the art and described below. The remainder of the concentrate is the substantially inert carrier liquid.

Lubricating Oil Compositions

In one embodiment of the invention, the oil soluble additive composition of the present invention can be mixed with a base oil of lubricating viscosity to form a lubricating oil composition. The lubricating oil composition comprises a major amount of a base oil of lubricating viscosity and a minor amount of the oil soluble additive composition of the present invention described above.

The lubricating oil which may be used in this invention includes a wide variety of hydrocarbon oils, such as naphthenic bases, paraffin bases and mixed base oils as well as synthetic oils such as esters and the like. The lubricating oils which may be used in this invention also include oils from biomass such as plant and animal derived oils. The lubricating oils may be used individually or in combination and generally have viscosity which ranges from 7 to 3,300 cSt and usually from 20 to 2000 cSt at 40° C. Thus, the base oil can be a refined paraffin type base oil, a refined naphthenic base oil, or a synthetic hydrocarbon or non-hydrocarbon oil of lubricating viscosity. The base oil can also be a mixture of mineral and synthetic oils. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

The lubricating oil compositions containing the oil soluble additives of this invention can be prepared by admixing, by conventional techniques, the appropriate amount of the oil soluble additives of the invention with a lubricating oil. The selection of the particular base oil depends on the contemplated application of the lubricant and the presence of other additives. Generally, the amount of the oil soluble additive of the invention in the lubricating oil composition of the invention will vary from 0.05 to 15% by weight, preferably from 0.1 to 1% by weight, and more preferred from about 0.1 to 0.8% by weight based on the total weight of the lubricating oil composition.

The lubricating oil composition may be used in passenger car engines, heavy duty diesel engines and the like.

Additional Additives

If desired, other additives may be included in the lubricating oil and lubricating oil concentrate compositions of this invention. These additives include antioxidants or oxidation inhibitors, dispersants, rust inhibitors, anticorrosion agents and so forth. Also, anti-foam agents, stabilizers, anti-stain agents, tackiness agents, anti-chatter agents, dropping point improvers, anti-squawk agents, extreme pressure agents, odor control agents and the like may be included.

The following additive components are examples of some of the components that can be favorably employed in the lubricating oil compositions of the present invention. These examples of additional additives are provided to illustrate the present invention, but they are not intended to limit it:

Metal Detergents

Detergents which may be employed in the present invention include alkyl or alkenyl aromatic sulfonates, metal salicylates, calcium phenate, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

Anti-Wear Agents

As their name implies, these agents reduce wear of moving metallic parts. Examples of such agents include, but are not limited to, zinc dithiophosphates, carbarmates, esters, and molybdenum complexes.

Rust Inhibitors (Anti-Rust Agents)

Anti-rust agents reduce corrosion on materials normally subject to corrosion. Examples of anti-rust agents include, but are not limited to, nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Other compounds useful as anti-rust agents include, but are not limited to, stearic acid and other alkyls, dicarboxylic acids, metal soaps, alkyl amine salts, metal salts of heavy sulfonic acid, partial carboxylic acid ester of polyhydric alcohol, and phosphoric ester.

Demulsifiers

Demulsifiers are used to aid the separation of an emulsion. Examples of demulsifiers include, but are not limited to, block copolymers of polyethylene glycol and polypropylene glycol, polyethoxylated alkylphenois, polyesteramides, ethoxylated alkylphenol-formaldehyde resins, polyvinytalcohol derivatives and cationic or anionic polyclectrolytes. Mixtures of different types of polymers may also be used.

Friction Modifiers

Additional friction modifiers may be added to the lubricating oil of the present invention. Examples of friction modifiers include, but are not limited to, fatty alcohols, alkyls, amines, ethoxylated amines, borated esters, other esters, phosphates, phosphites and phosphonates.

Multifunctional Additives

Additives with multiple properties such as anti-oxidant and anti-wear properties may also be added to the lubricating oil of the present invention. Examples of multifunctional additives include, but are not limited to, sulfurized oxymolybdenum dithiocarbamate, sulfurized oxymolybdenum organo phosphorodithioate, oxymolybdenum monoglyceride, oxymolybdenum diethylate amide, amine-molybdenum complexes, and sulfur-containing molybdenum complexes.

Viscosity Index Improvers

Viscosity index improvers, also known as viscosity modifiers, comprise a class of additives that improve the viscosity-temperature characteristics of the lubricating oil, making the oil's viscosity more stable as its temperature changes. Viscosity index improvers may be added to the lubricating oil composition of the present invention. Examples of viscosity index improvers include, but are not limited to, polymethacrylate type polymers, ethylene-propylene copolymers, styrene-isoprene copolymers, alkaline earth metal salts of phosphosulfurized polyisobutylene, hydrated styrene-isoprene copolymers, polyisobutylene, and dispersant type viscosity index improvers.

Pour Point Depressants

Pour point depressants are polymers that are designed to control wax crystal formation in lubricating oils resulting in lower pour point and improved low temperature flow performance. Examples of pour point depressants include, but are not limited to, polymethyl methacrylate, ethylene vinyl acetate copolymers, polyethylene polymers, and alkylated polystyrenes.

Foam Inhibitors

Foam inhibitors are used to reduce the foaming tendencies of the lubricating oil. Examples of foam inhibitors include, but are not limited to, alkyl methacrylate polymers, alkylacrylate copolymers, and polymeric organosiloxanes such as dimethylsiloxane polymers.

Metal Deactivators

Metal deactivators create a film on metal surfaces to prevent the metal from causing the oil to be oxidized. Examples of metal deactivators include, but are not limited to, disalicylidene propylenediamine, triazole derivatives, thiadiazole derivatives, bis-imidazole ethers, and mercaptobenzimidazoles.

Dispersants

Dispersants diffuse sludge, carbon, soot, oxidation products, and other deposit precursors to prevent them from coagulating resulting in reduced deposit formation, less oil oxidation, and less viscosity increase. Examples of dispersants include, but are not limited to, alkenyl succinimides, alkenyl succinimides modified with other organic compounds, alkenyl succinimides modified by post-treatment with ethylene carbonate or boric acid, alkali metal or mixed alkali metal, alkaline earth metal borates, dispersions of hydrated alkali metal borates, dispersions of alkaline-earth metal borates, polyamide ashless dispersants and the like or mixtures of such dispersants.

Anti-Oxidants

Anti-oxidants reduce the tendency of mineral oils to deteriorate by inhibiting the formation of oxidation products such as sludge and varnish-like deposits on the metal surfaces. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). Diphenylamine-type oxidation inhibitors include, but are not limited to, alkylated diphenylamine, phenyl-alpha-naphthylamine, and alkylated-alpha-naphthylamine Other types of oxidation inhibitors include metal dithiocarbamate (e.g., zinc dithiocarbamate), and methylenebis(dibutyldithiocarbamate).

Applications

Lubricating oil compositions containing the oil soluble additive compositions disclosed herein are effective as either fluid and grease compositions for modifying the friction properties of the lubricating oil which may, when used as a crankcase lubricant, lead to improved fuel economy for an engine being lubricated with a lubricating oil of this invention.

The lubricating oil compositions of this invention may be used in natural gas engine oils, marine cylinder lubricants as in crosshead diesel engines, crankcase lubricants as in automobiles and railroads, lubricants for heavy machinery such as steel mills and the like, or as greases for bearings and the like. Whether the lubricant is fluid or solid will ordinarily depend on whether a thickening agent is present. Typical thickening agents include polyurea acetates, lithium stearate and the like.

The following examples are presented to illustrate specific embodiments of this invention and are not to be construed in any way as limiting the scope of the invention.

EXAMPLES

Example 1

Alkylated Aromatic Ether Alcohol Reacted With Boric Acid and Glycerol

A flask was charged with 50 grams of Igepal 210®, which may be purchased from Sigma-Aldrich, 8.0 grams of boric acid, and 11.7 grams of glycerol at 1.0:0.75:0.75 equivalents, respectively. The mixture was heated to 110 degrees Celsius, held for three (3) hours under house vacuum and a nitrogen blanket. A dean stark trap was used to collect water. The product was poured out and tested in the Mini-Traction Machine. The test results of the product were compared to only using Igepal 210®.

Friction Reduction Measured by Mini-Traction Machine

The lubricating oil additives prepared in Examples 1 and Igepal 2100 were evaluated for friction reducing properties under a Mini-Traction Machine (MTM) bench test.

Two baselines were tested using a bench tribometer. Within each baseline all lubricants tested contained identical amounts of additives, exclusive of a friction modifier, (the "baseline additive package") including dispersant, detergents, zinc dialkyldithiophosphate, antioxidant, polymethacrylate pour point depressant, and olefin copolymer viscosity index improver.

The friction modifier of the invention (Example 1) and Igepal 210® were added at a treat rate of 1% by weight.

The compositions described above were tested for friction performance in a Mini-Traction Machine (MTM) bench test. The MTM is manufactured by PCS Instruments and operates with a ball (0.75 inches in diameter 8620 steel ball) loaded against a rotating disk (52100 steel). The conditions employ a load of approximately 10-30 Newtons, a speed of approximately 10-2000 mm/s and a temperature of approximately 125-150° C. In this bench test, friction performance is measured as the total area under the second Stribeck curve generated. Lower total area values correspond to better friction performance.

TABLE 1

| Friction Modifier Used in Lubricating Oil | |
|---|---|
| Friction Modifier | MTM Result |
| Example 1 | 119 |
| Igepal 210 ® (Comparative Example) | 124 |

When used in a passenger car engine oil, the lubricating oil composition formulated with the friction modifier of the invention (Example 1) has better friction reduction than that of the lubricating oil composition formulated with Igepal 210®

Example 2

Alkylated Ethoxylated Resorcinol Reacted With Boric Acid and Glycerol

A three-step process was performed to produce the final product.

Step 1: Resorcinol (75 g, 0.677 mol, 2 eq) was charged into a round-bottom flask followed by charging 1-Dodecene (56.93 g, 0.338 mol, 1 eq) into the round-bottom flask. The reaction mixture was heated to 110° C., stirred, and kept under a $N_2$ blanket. Once the resorcinol is melted, 2 drops of pure sulfuric acid was added to the round-bottom flask. The reaction was held overnight under the same conditions. At the end of the reaction, the reaction mixture was worked up using ethyl acetate and diethyl ether dilution, washed with water and brine. The organic phase was dried using sodium sulfate and rotary evaporated. The product was analyzed.

Step 2: Alkylated resorcinol (50 g, 0.1506 mol, 1 eq) from the previous step was charged into a round-bottom flask. The flask was heated to 120° C. under high $N_2$ blanket for 30 minutes. Potassium t-Butoxide (3.37 g, 0.0301 mol, 0.2 eq) was charged into the round-bottom flask. The temperature was raised to 150° C. The reaction was held for 2 hours. Ethylene Carbonate (27 g, 0.3162 mol, 2.1 eq) was charged into the round-bottom flask in small portions every 10 minutes for 2 hours at the same conditions. At the end of the reaction, the reaction mixture was worked up with ethyl acetate with methanol and washed with water and brine. The organic phase was then dried with sodium sulfate and rotary evaporated. This intermediate product is Comparative Example A.

Step 3: Alkylated ethoxylated resorcinol (23.53 g, 0.0560 mol, 1 eq) from the previous step, glycerol (9.019 g, 0.0780 mol, 1.75 eq), boric acid (6.06 g, 0.0780 mol, 1.75 eq), and toluene (250 ml) was charged to a round-bottom flask. The reaction temperature was set to 120° C. and stirred. A dean stark trap was attached to catch the water. The reaction is complete once water was no longer evaporated from the reaction mixture. At the end of the reaction, the toluene was rotary evaporated and this compound was tested in the viton compatibility test AK-6. This final product is Example 2.

Comparative Example B

Comparative Example B is diethanolamide derived from coconut oil.

Mazda Screener

The lubricating oil additives prepared in Example 2 and in Comparative Examples A and B were evaluated for fuel economy properties in the Mazda Screener.

All formulated lubricating oil compositions contained identical amounts of additives, exclusive of a friction modifier, (the "baseline additive package") including dispersant, detergents, zinc dialkyldithiophosphate, antioxidant, polymethacrylate pour point depressant, and olefin copolymer viscosity index improver. Friction modifiers, of the invention and comparative examples, were added as a top treat to this baseline formulation of 0.5 wt %.

The fuel economy performance of lubricating oil compositions containing different organic friction modifiers was evaluated. A V-6 2.5 L engine was adjusted to run at a rotational speed of 1400 r/min and a temperature of about 107-120° C. Three high detergent oil flushes were first run through the engine for twenty minutes each. The engine was then operated for two hours with a lubricant which contained the baseline lubricant formulation without a friction modifier. After two hours, thirty grams of a lubricating oil containing the baseline additive package was top treated with 0.5 wt % of the friction modifier and was added to the engine through a specially adapted oil fill cap. The engine was allowed to stabilize for two hours.

The brake specific fuel consumption (BSFC) was evaluated by averaging the BSFC for a period of one hour prior to the addition of the top treated lubricating oil composition and averaging the BSFC for a period of two hours immediately following the addition of the top treated lubricating oil composition. Results are reported as the change in BSFC between the BSFC of the one hour before the addition of the top treated lubricating oil composition and the BSFC of the two hours after the addition of the top treated lubricating oil composition. Results are reported as an average of two runs. A more negative value corresponds to higher fuel economy benefit. The results of this evaluation are shown in the table below.

TABLE 2

| Friction Modifier Used in Lubricating Oil | | |
|---|---|---|
| Friction Modifier | Treat Rate (%) | Mazda BSFC (%) |
| Example 2 | 0.38 | −1.21 |
| Comparative Example A | 0.38 | −0.44 |
| Comparative Example B | 0.77 | −1.60 |

The performance of the friction modifier of Example 2—which was the final product that included a step of coborating with glycerol—is about three (3) times better than Comparative Example A. The performance of Example 2 is close to the performance of Comparative Example B, even though the treat rate of Example 2 is about half the treat rate of Comparative Example B.

What is claimed is:

1. A lubricating oil additive composition comprising the reaction product of an (a) an alkylated aromatic ether alcohol, wherein the alkylated aromatic ether alcohol is of the formula (I):

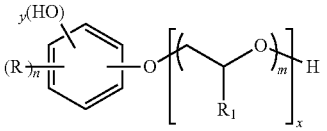

(I)

wherein R is an alkyl group having from 2 to 40 carbon atoms, $R_1$ is hydrogen or an alkyl group having from 1 to 10 carbon atoms, m is an integer from 1 to 60, n is an integer from 1 to 5, x is an integer from 1 to 5, y is 0 or an integer from 1 to 4, and the sum of n+y+x is equal to an integer from 2 to 6, (b) a source of boron, and (c) an alkyl polyol, having at least two hydroxyl groups.

2. The lubricating oil additive composition of claim 1 wherein the alkyl group in the alkylated aromatic ether alcohol has from about 2 to about 40 carbon atoms.

3. The lubricating oil additive composition of claim 2 wherein the alkyl group in the alkylated ether alcohol has from about 2 to about 12 carbon atoms.

4. The lubricating oil additive composition of claim 1 wherein the alkylated aromatic ether alcohol is dodecyl resorcinol ether alcohol.

5. The lubricating oil additive composition of claim 1 wherein the source of boron is boric acid.

6. The lubricating oil additive composition of claim 1 wherein the alkyl polyol is glycerol, diglycerol, or pentaerythritol.

7. The lubricating oil additive composition of claim 1 wherein the ratio of the alkylated aromatic ether alcohol, the source of boron and the alkyl polyol is from about 1:0.2:0.2 to 1:3:3, respectively.

8. A lubricating oil composition comprising

A. major amount of an oil of lubricating viscosity and

B. a lubricating oil additive composition comprising the reaction product of (i) an alkylated aromatic ether alcohol, wherein the alkylated aromatic ether alcohol is of the formula (I):

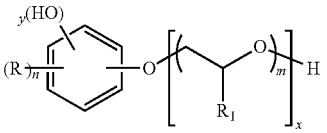

(I)

wherein R is an alkyl group having from 2 to 40 carbon atoms, $R_1$ is hydrogen or an alkyl group having from 1 to 10 carbon atoms, m is an integer from 1 to 60, n is an integer from 1 to 5, x is an integer from 1 to 5, y is 0 or an integer from 1 to 4, and the sum of n+y+x is equal to an integer from 2 to 6, (ii) a source of boron, and (iii) an alkyl polyol, having at least three hydroxyl groups.

9. The lubricating oil composition of claim 8 wherein the alkyl group in the alkylated aromatic ether alcohol has from about 2 to about 40 carbon atoms.

10. The lubricating oil composition of claim 9 wherein the alkyl group in the alkylated aromatic ether alcohol has from about 2 to about 12 carbon atoms.

11. The lubricating oil composition of claim 8 wherein the alkylated aromatic ether alcohol is dodecyl resorcinol ether alcohol.

12. The lubricating oil composition of claim 8 wherein the source of boron is boric acid.

13. The lubricating oil composition of claim 8 wherein the alkyl polyol is glycerol, diglycerol, or pentaerythritol.

14. A method for reducing friction in an internal combustion engine comprising lubricating said engine with a lubricating oil composition comprising the lubricating oil composition of claim 8.

15. A lubricating oil additive concentrate comprising from about 90 wt. % to about 10 wt. % of an organic liquid diluent and from about 10 wt. % to about 90 wt. % of the lubricating oil additive composition of claim 1.

16. A method of preparing a lubricating oil additive composition comprising reacting (a) an alkylated aromatic ether alcohol, wherein the alkylated aromatic ether alcohol is of the formula (I):

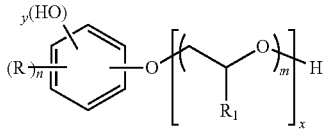

(I)

wherein R is an alkyl group having from 2 to 40 carbon atoms, $R_1$ is hydrogen or an alkyl group having from 1 to 10 carbon atoms, m is an integer from 1 to 60, n is an integer from 1 to 5, x is an integer from 1 to 5, y is 0 or an integer from 1 to 4, and the sum of n+y+x is equal to an integer from 2 to 6, (b) a source of boron, and (c) an alkyl polyol, having at least three hydroxyl groups.

17. The method of claim 16 wherein the ratio of the alkylated aromatic ether alcohol, the source of boron and the alkyl polyol is from about 1:0.2:0.2 to 1:3:3, respectively.

18. The method of claim 16 wherein the alkyl group in the alkylated aromatic ether alcohol has from about 2 to about 40 carbon atoms.

19. The method of claim 18 wherein the alkyl group in the alkylated aromatic ether alcohol has from about 2 to about 12 carbon atoms.

20. The method of claim 16 wherein the alkylated aromatic ether alcohol is dodecyl resorcinol ether alcohol.

21. The method of claim 16 wherein the source of boron is boric acid.

22. The method of claim 16 wherein the alkyl polyol is glycerol, diglycerol, or pentaerythritol.

23. The lubricating oil additive composition of claim 1, wherein the alkyl polyol is of the formula:

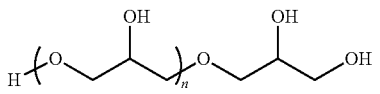

wherein n is 0 or an integer from 1 to 5.

24. The lubricating oil composition of claim 8, wherein the alkyl polyol is of the formula:
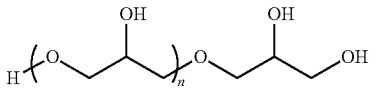
wherein n is 0 or an integer from 1 to 5.
25. The method of claim 16, wherein the alkyl polyol is of the formula:
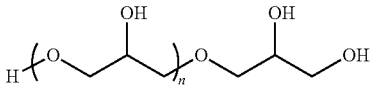
wherein n is 0 or an integer from 1 to 5.
* * * * *